US008473284B2

(12) United States Patent
Lee et al.

(10) Patent No.: US 8,473,284 B2
(45) Date of Patent: Jun. 25, 2013

(54) APPARATUS AND METHOD OF ENCODING/DECODING VOICE FOR SELECTING QUANTIZATION/DEQUANTIZATION USING CHARACTERISTICS OF SYNTHESIZED VOICE

(75) Inventors: Kangeun Lee, Gangneung-Si (KR); Hosang Sung, Yongin-si (KR); Kihyun Choo, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 507 days.

(21) Appl. No.: 11/097,319

(22) Filed: Apr. 4, 2005

(65) Prior Publication Data

US 2006/0074643 A1 Apr. 6, 2006

(30) Foreign Application Priority Data

Sep. 22, 2004 (KR) ..... 10-2004-0075959

(51) Int. Cl.
*G10L 19/12* (2006.01)

(52) U.S. Cl.
USPC ..... 704/222; 704/500; 704/262; 704/253; 704/230; 704/223; 704/219; 704/208; 375/240.25; 375/216

(58) Field of Classification Search
USPC ..... 704/219, 500, 230, 262, 253, 223, 704/222, 208; 375/216, 240.25
See application file for complete search history.

(56) References Cited

U.S. PATENT DOCUMENTS

| | | | | |
|---|---|---|---|---|
| 5,428,394 | A * | 6/1995 | Yamagami et al. | 375/240.25 |
| 5,732,389 | A * | 3/1998 | Kroon et al. | 704/223 |
| 5,774,839 | A * | 6/1998 | Shlomot | 704/222 |
| 5,822,723 | A * | 10/1998 | Kim et al. | 704/222 |
| 5,893,061 | A * | 4/1999 | Gortz | 704/262 |
| 5,966,688 | A * | 10/1999 | Nandkumar et al. | 704/222 |
| 5,995,923 | A * | 11/1999 | Mermelstein et al. | 704/219 |
| 6,003,004 | A * | 12/1999 | Hershkovits et al. | 704/253 |
| 6,067,511 | A * | 5/2000 | Grabb et al. | 704/223 |
| 6,097,753 | A * | 8/2000 | Ko | 375/216 |
| 6,098,036 | A * | 8/2000 | Zinser et al. | 704/219 |
| 6,122,608 | A * | 9/2000 | McCree | 704/219 |
| 6,275,796 | B1 * | 8/2001 | Kim et al. | 704/230 |
| 6,438,517 | B1 * | 8/2002 | Yeldener | 704/208 |
| 6,665,646 | B1 * | 12/2003 | John et al. | 704/500 |
| 6,691,082 | B1 * | 2/2004 | Aguilar et al. | 704/219 |
| 2004/0176951 | A1 * | 9/2004 | Sung et al. | 704/222 |
| 2004/0230429 | A1 * | 11/2004 | Son et al. | 704/230 |

FOREIGN PATENT DOCUMENTS

KR 2003-0062361 7/2003

* cited by examiner

*Primary Examiner* — Michael Colucci
(74) *Attorney, Agent, or Firm* — Staas & Halsey LLP

(57) ABSTRACT

A voice encoding/decoding method and apparatus. A voice encoder includes: a quantization selection unit generating a quantization selection signal; and a quantization unit extracting a linear prediction coding (LPC) coefficient from an input signal, converting the extracted LPC coefficient into a line spectral frequency (LSF), quantizing the LSF with a first LSF quantization unit or a second LSF quantization unit based on the quantization selection signal, and converting the quantized LSF into a quantized LPC coefficient. The quantization selection signal selects the first LSF quantization unit or second LSF quantization unit based on characteristics of a synthesized voice signal in previous frames of the input signal.

30 Claims, 5 Drawing Sheets

APPARATUS AND METHOD OF ENCODING/DECODING VOICE FOR SELECTING QUANTIZATION/DEQUANTIZATION USING CHARACTERISTICS OF SYNTHESIZED VOICE

CROSS-REFERENCE TO RELATED APPLICATION

This application claims the priority of Korean Patent Application No. 10-2004-0075959, filed on Sep. 22, 2004, in the Korean Intellectual Property Office, the disclosure of which is incorporated herein in its entirety by reference.

BACKGROUND OF THE INVENTION

1. Field of the Invention

The present invention relates to an apparatus of encoding/decoding voice, and more specifically, to an apparatus for and method of selecting encoding/decoding appropriate to voice characteristics in a voice encoding/decoding apparatus.

2. Description of Related Art

A conventional linear prediction coding (LPC) coefficient quantizer obtains an LPC coefficient to perform linear prediction on signals input to a encoder of a voice compressor/decompressor (codec), and quantizes the LPC coefficient to transmit it to the decoder. However, there are problems in that an operating range of the LPC coefficient is too wide to be directly quantized by the LPC coefficient quantizer and a filter stability is not guaranteed even with small errors. Therefore, the LPC coefficient is quantized by converting into a line spectral frequency (LSF), which is mathematically equivalent with good quantization characteristics.

In general, in the case of narrow band speech codec that has 8 kHz input speech, 10 LSFs are made for representing spectral envelope. Here, the tenth-order LSF has a high correlation in a short term, and a ordering property among respective elements in the LSF vector, so that a predictive vector quantizer is used. However, when a frame in which frequency characteristics of the voice are rapidly changed, there occur a lot of errors due to a predictor so that the quantization performance is degraded. Accordingly, a quantizer having two predictors has been used to quantize the LSF vector having low inter-correlation correlation.

FIG. 1 is a diagram showing a typical arrangement of an LSF quantizer having two predictors.

An LSF vector input to an LSF quantizer is input to a first vector quantization unit 111 and a second vector quantization unit 121 through lines, respectively. Here, respective first and second subtractors 100 and 105 subtract LSF vectors predicted by respective first and second predictors 115 and 125 from the LSF vector respectively input to the first vector quantization unit 111 and the second vector quantization unit 121, respectively. A process of subtracting the LSF vector is shown in the following equation. 1.

$$r^i_{1,n} = \left(f^i_n - \tilde{f}^i_{1,n}\right) / \beta^i_1 \qquad \text{[Equation 1]}$$

where, $r^i_{1,n}$ is a prediction error of an ith element in an nth frame of the LSF vector of the first vector quantizer 110 $f^i_n$ is an ith element in the nth frame of LSF vector, $$\tilde{f}^i_{1,n}$$

is an ith element in the nth frame of the predicted LSF vector of the first vector quantization unit 111, and $\beta^i_1$ is a prediction coefficient between $r^i_{1,n}$ and $f^i_n$ of the first vector quantization unit 111.

The prediction error signal output through the first subtractor 100 is vector quantized by the first vector quantizer 110. The quantized prediction error signal is input to the first predictor 115 and a first adder 130. The quantized prediction error signal input to the first predictor 115 is calculated as shown in the following equation 2 to predict the next frame and then stored into a memory.

$$\tilde{f}^i_{1,n+1} = \alpha^i_1 \hat{r}^i_{1,n} \quad i = 1, \ldots, 10 \qquad \text{[Equation 2]}$$

wherein, $\hat{r}_{1,n}{}^i$ is an ith element in an nth frame of the quantized prediction error signal of the first vector quantizer 110, and $\alpha^i_1$ is an prediction coefficient of the ith element of the first vector quantization unit 111.

The first adder 130 adds the predicted signal to the LSF prediction error vector quantized by the first vector quantizer 110. The LSF prediction error vector added to the predicted signal is output to the LSF vector selection unit 140 via the line. The predicted signal adding process by the first adder 130 is performed as shown in Equation 3.

$$\hat{f}^i_{1,n} = \tilde{f}^i_{1,n} + \beta^i_1 \hat{r}^i_{1,n} \quad i = 1, \ldots 10 \qquad \text{[Equation 3]}$$

where, $\hat{r}_{1,n}{}^i$ is an ith element in the nth frame of the quantized prediction error signal of the first vector quantizer 110. The LSF vector input to the second vector quantization unit 121 through the line subtracts a LSF predicted by the second predictor 125 through the second subtractor 105 to output a predicted error. The predicted error signal subtraction is calculated as the following equation 4.

$$r^i_{2,n} = \left(f^i_n - \tilde{f}^i_{2,n}\right) / \beta^i_2 \quad i = 1, \ldots, 10 \qquad \text{[Equation 4]}$$

where, $r^i_{2,n}$ is a prediction error of an ith element in an nth frame of the LSF vector of the second vector quantizer 121, $f^i_n$ is an ith element in the nth frame of LSF vector, $$\tilde{f}^i_{2,n}$$

is an ith element in the nth frame of the prediction LSF vector of the second vector quantization unit 121, and $\beta^i_2$ is a prediction coefficient between $r^i_{2,n}$ and $f^i_n$ of the second vector quantization unit 121.

The prediction error signal output through the second subtractor 105 is quantized by the second vector quantizer 120. The quantized prediction error signal is input to the second predictor 125 and a second adder 135. The quantized prediction error signal input to the second predictor 125 is calculated as shown in the following equation 5 to predict the next frame and then stored into a memory.

$$\tilde{f}^{i}_{2,n+1} = \alpha^{i}_{2}\hat{r}^{i}_{2,n} \quad i = 1, \ldots, 10 \qquad \text{[Equation 5]}$$

wherein, $\hat{r}_{2,n}{}^{i}$ is an ith element in an nth frame of the quantized prediction error signal of the second vector quantization unit 121, and $\alpha^{i}{}_{2}$ is an prediction coefficient of the ith element of the second vector quantization unit 121.

The signal input to the second adder 135 is added to the predicted signal and the LSF vector quantized by the second quantizer 120 is output to the switch selection unit 140 through the lines. The predicted signal adding process by the second adder 135 is performed as shown in Equation 6.

$$\hat{f}^{i}_{2,n} = \tilde{f}^{i}_{2,n} + \beta^{i}_{2}\hat{r}^{i}_{2,n} \quad i = 1, \ldots, 10 \qquad \text{[Equation 6]}$$

where, $\hat{r}_{2,n}{}^{i}$ is an ith element of a quantized vector of an nth frame of the prediction error signal in the second vector quantizer 120. An LSF vector selection unit 140 calculates a difference between the original LSF vector and the quantized LSF vector output from the respective first and second quantization units 111 and 121, and inputs a switch selection signal selecting a smaller LSF vector into the switch selection unit 145. The switch selection unit 145 selects the quantized LSF having the smaller difference with the original LSF vector, among the quantized LSF vectors by the respective first and second vector quantization units 111 and 121 by using the switch selection signal, and outputs the selected quantized LSF to the lines.

In general, the respective first and second vector quantization units 111 and 121 have the same configuration. However, to more flexibly respond to the correlation between frames of the LSF vector, other predictors 115 and 125 are used. Each of the vector quantizers 110 and 120 has a codebook. Therefore, calculation amount is twice as large as with one quantization unit. In addition, one bit of the switch selection information is transmitted to the decoder to inform the decoder of a selected quantization unit.

In the conventional quantizer arrangement described above, the quantization is performed by using two quantization units in parallel. Thus, the complexity is twice as large as with one quantization unit and one bit is used to represent the selected quantization unit. In addition, when the switching bit is corrupted on the channel, the decoder may select the wrong quantization unit. Therefore, the voice decoding quality may be seriously degraded.

Thus, there is a need for a voice encoding/decoding apparatus and method capable of causing specific quantization/dequantization for a current frame to be performed based on characteristics of the voice synthesized in previous frames to reduce complexity and calculation amount and efficiently performing LSF quantization in a CELP series voice codec.

BRIEF SUMMARY

According to an aspect of the present invention, there is provided a voice encoder including: a quantization selection unit generating a quantization selection signal; and a quantization unit extracting a linear prediction coding (LPC) coefficient from an input signal, converting the extracted LPC coefficient into a line spectral frequency (LSF), quantizing the LSF with a first LSF quantization unit or a second LSF quantization unit based on the quantization selection signal, and converting the quantized LSF into a quantized LPC coefficient. The the quantization selection signal selects the first LSF quantization unit or second LSF quantization unit based on characteristics of a synthesized voice signal in previous frames of the input signal.

According to an aspect of the present invention, there is provided a method of selecting quantization in a voice encoder, including: extracting a linear prediction encoding (LPC) coefficient from an input signal; converting the extracted LPC coefficient into a line spectral frequency (LSF); quantizing the LSF through a first quantization process or second LSF quantization process based on characteristics of a synthesized voice signal in previous frames of the input signal; and converting the quantized LSF into an quantized LPC coefficient.

According to an aspect of the present invention, there is provided a voice decoder including: a dequantization unit dequantizing line spectral frequency (LSF) quantization information to generate an LSF vector, and converting the LSF vector into a linear prediction coding (LPC) coefficient, the LSF quantization information being received through a specified channel and dequantized by using a first LSF dequantization unit or second LSF dequantization unit based on a dequantization selection signal; and a dequantization selection unit generating the dequantization selection signal, the dequantization selection signal selecting the first LSF dequantization unit or the second LSF dequantization unit based on characteristics of a synthesized signal in previous frames. The synthesized signal is generated from synthesis information of a received voice signal.

According to an aspect of the present invention, there is provided a method of selecting dequantization in a voice decoder, including: receiving line spectral frequency (LSF) quantization information and voice signal synthesis information through a specified channel; dequantizing the LSF through a first dequantization process or a second LSF dequantization process to generate an LSF vector based on characteristics of a synthesized voice signal in a previous frame of a synthesized signal, wherein the synthesized signal is generated from the voice signal synthesis information by using the LSF quantization information; and converting the LSF quantization vector into an LPC coefficient.

According to another embodiment of the present invention, there is provided a quantization selection unit of a voice encoder, including: an energy calculation unit receiving a synthesized voice signal, calculating respective energy values of the subframes; an energy buffer receiving and storing the calculated energy values to obtain the moving average of the calculated energy values; a moving average calculation unit calculating two energy moving values; an energy increase calculation unit receiving the calculated energy values and the two energy moving values, and calculating an energy increase; an energy decrease calculation unit receiving the calculated energy values and the two energy moving values, and calculating an energy decrease; an zero crossing calculation unit which receives the synthesized voice signal and calculating a changing a zero crossing rate; a pitch difference calculation unit receiving a pitch delay and calculating a difference of the pitch delay; and a selection signal generation unit receiving the energy increase, the energy decrease, and the calculated difference, and generating a selection signal selecting a quantization unit appropriate for the voice encoding, based on the energy increase of the energy increase calculation unit, the energy decrease of the energy decrease calculation unit, the zero crossing rate of the zero crossing calculation unit, and the pitch difference of the pitch difference calculation unit.

According to another embodiment of the present invention, there is provided a dequantization selection unit of a voice decoder, including: an energy calculation unit receiving a synthesized voice signal, calculating respective energy values of the subframes; an energy buffer receiving and storing the calculated energy values to obtain the moving average of the calculated energy values; a moving average calculation unit calculating two energy moving values; an energy increase calculation unit receiving the calculated energy values and the two energy moving values, and calculating an energy increase; an energy decrease calculation unit receiving the calculated energy values and the two energy moving values, and calculating an energy decrease; an zero crossing calculation unit which receives the synthesized voice signal and calculating a changing a zero crossing rate; a pitch difference calculation unit receiving a pitch delay and calculating a difference of the pitch delay; and a selection signal generation unit receiving the energy increase, the energy decrease, and the calculated difference, and generating a selection signal selecting a dequantization unit appropriate for the voice encoding, based on the energy increase of the energy increase calculation unit, the energy decrease of the energy decrease calculation unit, the zero crossing rate of the zero crossing calculation unit, and the pitch difference of the pitch difference calculation unit.

Therefore, quantization/dequantization can be selected according to voice characteristics in encoder/decoder.

Additional and/or other aspects and advantages of the present invention will be set forth in part in the description which follows and, in part, will be obvious from the description, or may be learned by practice of the invention.

BRIEF DESCRIPTION OF THE DRAWINGS

These and/or other aspects and advantages of the present invention will become apparent and more readily appreciated from the following detailed description, taken in conjunction with the accompanying drawings of which.

DETAILED DESCRIPTION OF EMBODIMENT

Figure 1:
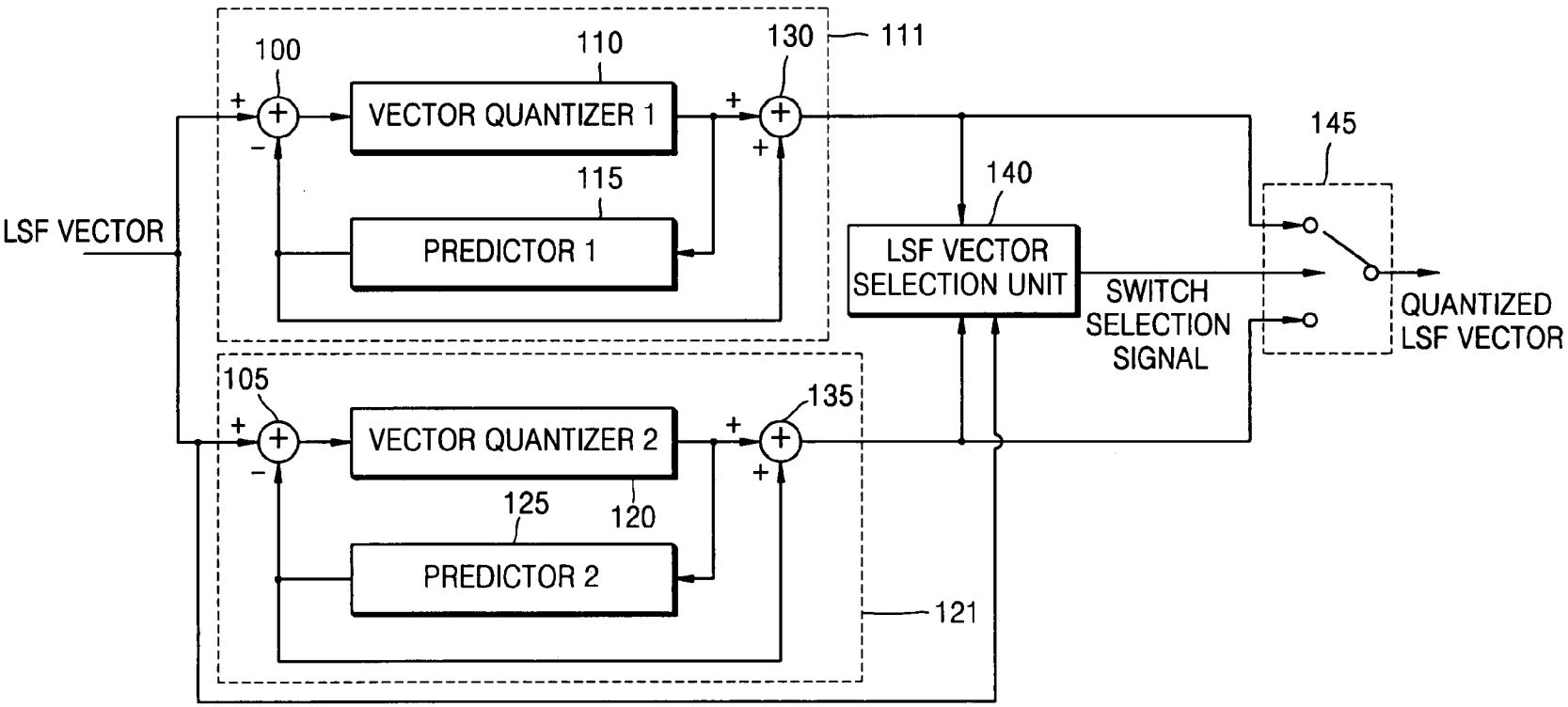
FIG. 1 (PRIOR ART)
FIG. 1 is a schematic diagram of the arrangement of a conventional line spectral frequency (LSF) quantizer having two predictors.

Reference will now be made in detail to an embodiment of the present invention, examples of which are illustrated in the accompanying drawings, wherein like reference numerals refer to the like elements throughout. The embodiment is described below in order to explain the present invention by referring to the figures.

Now, voice encoding/decoding apparatus and quantization/dequantization selection method will be described with reference to the attached drawings.

Figure 2:
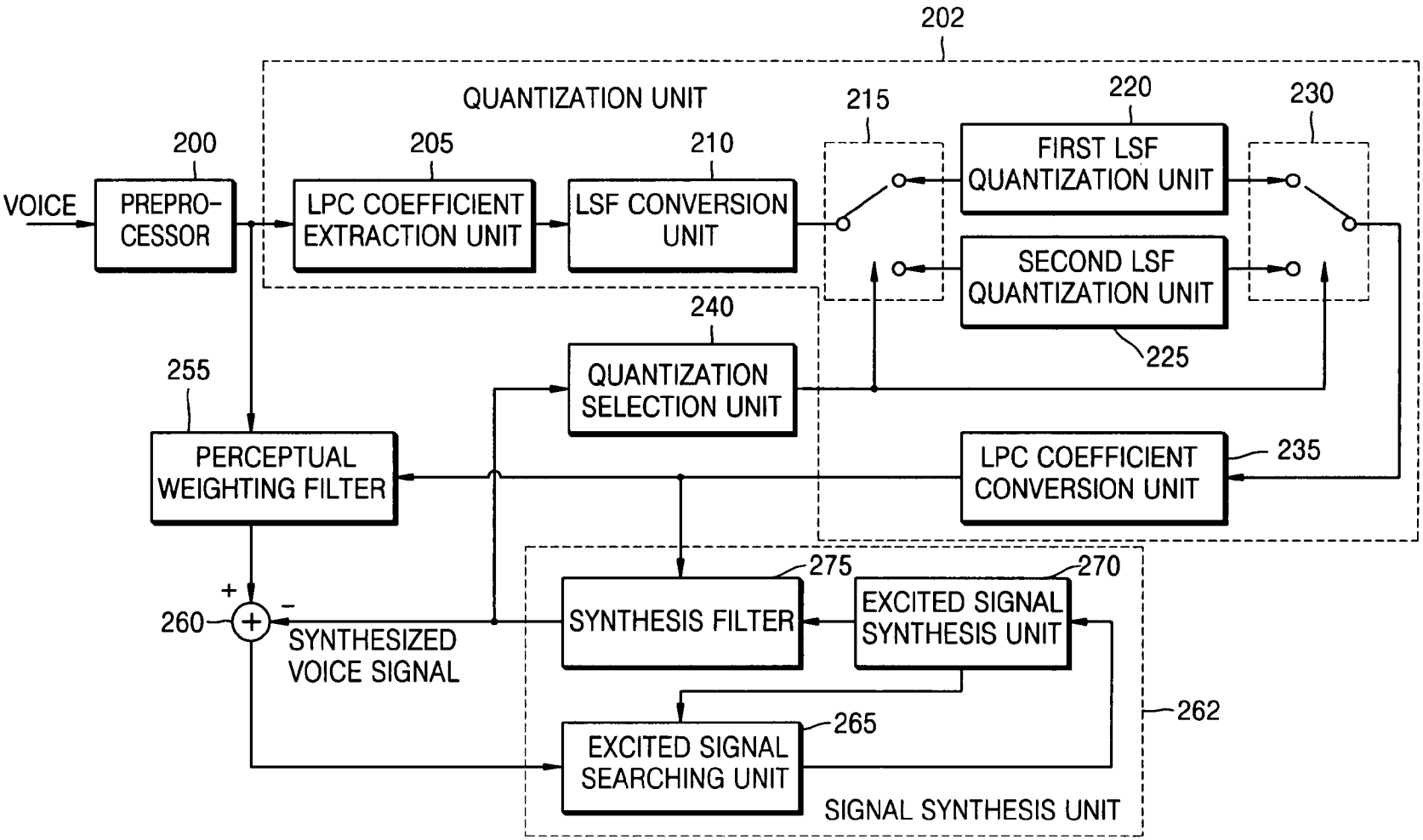
FIG. 2 is a block diagram showing a voice encoder in a code-excited linear prediction (CELP) arrangement according to an embodiment of the present invention.

FIG. 2 is a block diagram showing a voice encoder in a code-excited linear prediction (CELP) arrangement according to an embodiment of the present invention;

The voice encoder includes a preprocessor 200, a quantization unit 202, a perceptual weighting filter 255, a signal synthesis unit 262 and a quantization selection unit 240. Further, the quantization unit 202 includes an LPC coefficient extraction unit 205, an LSF conversion unit 210, a first selection switch 215, a first LSF quantization unit 220, a second LSF quantization unit 225 and a second selection switch 230. The signal synthesis unit 262 includes an excited signal searching unit 265, an excited signal synthesis unit 270 and a synthesis filter 275.

The preprocessor 200 takes a window for a voice signal input through a line. The windowed signal in window is input to the linear prediction coding (LPC) coefficient extraction unit 205 and the perceptual weighting filter 255. The LPC coefficient extraction unit 205 extracts the LPC coefficient corresponding to the current frame of the input voice signal by using autocorrelation and Levinson-Durbin algorithm. The LPC coefficient extracted by the LPC coefficient extraction unit 205 is input to the LSF conversion unit 210.

The LSF conversion unit 210 converts the input LPC coefficient into a line spectral frequency (LSF), which is more suitable in vector quantization, and then, outputs the LSF to the first selection switch 215. The first selection switch 215 outputs the LSF from the LSF conversion unit 210 to the first LSF quantization unit 220 or the second LSF quantization unit 225, according to the quantization selection signal from the quantization selection unit 240.

The first LSF quantization unit 220 or the second LSF quantization unit 225 outputs the quantized LSF to the second selection switch 230. The second selection switch 230 selects the LSF quantized by the first LSF quantization unit 220 or the second LSF quantization unit 225 according to the quantization selection signal from the quantization selection unit 240, as in the first selection switch 215. The second selection switch 230 is synchronized with the first selection switch 215.

Further, the second selection switch 230 outputs the selected quantized LSF to the LPC coefficient conversion unit 235. The LPC coefficient conversion unit 235 converts the quantized LSF into a quantized LPC coefficient, and outputs the quantized LPC coefficient to the synthesis filter 275 and the perceptual weighting filter 255.

The perceptual weighting filter 255 receives the windowed voice signal in window from the preprocessor 200 and the quantized LPC coefficient from the LPC coefficient conversion unit 235. The perceptual weighting filter 255 perceptually weights the windowed voice signal, using the quantized LPC coefficient. In other words, the perceptual weighting filter 255 causes the human ear not to perceive a quantization noise. The perceptually weighted voice signal is input to a subtractor 260.

The synthesis filter 275 synthesizes the excited signal received from the excited signal synthesis unit 270, using the quantized LPC coefficient received from the LPC coefficient conversion unit 235, and outputs the synthesized voice signal to the subtractor 260 and the quantization selection unit 240.

The subtractor 260 obtains a linear prediction remaining signal by subtracting the synthesized voice signal received from the synthesis filtering unit 275 from the perceptually weighted voice signal received from the perceptual weighting filter 255, and outputs the linear prediction remaining signal to the excited signal searching unit 265. The linear prediction remaining signal is generated as shown in the following Equation 7.

$$x(n) = s_w(n) - \sum_{i=1}^{10} \hat{a}_i \cdot \hat{s}(n-i) \quad n = 0, \ldots, L-1 \qquad \text{[Equation 7]}$$

where, x(n) is the linear prediction remaining signal, $s_w(n)$ is the perceptually weighted voice signal, $\hat{a}_i$ is an ith element of the quantized LPC coefficient vector, $\hat{s}(n)$ is the synthesized voice signal, and L is the number of sample per one frame.

The excited signal searching unit 265 is a block for representing a voice signal which can not be represented with the synthesis filter 275. For a typical voice codec, two searching units are used. The first searching unit represents periodicity of the voice. The second searching unit, which is a second excited signal searching unit, is used to efficiently represent the voice signal that is not represented by pitch analysis and the linear prediction analysis.

In other words, the signal input to the excited signal searching unit 265 is represented by a summation of the signal delayed by the pitch and the second excited signal, and is output to the excited signal synthesis unit 270.

Figure 3:
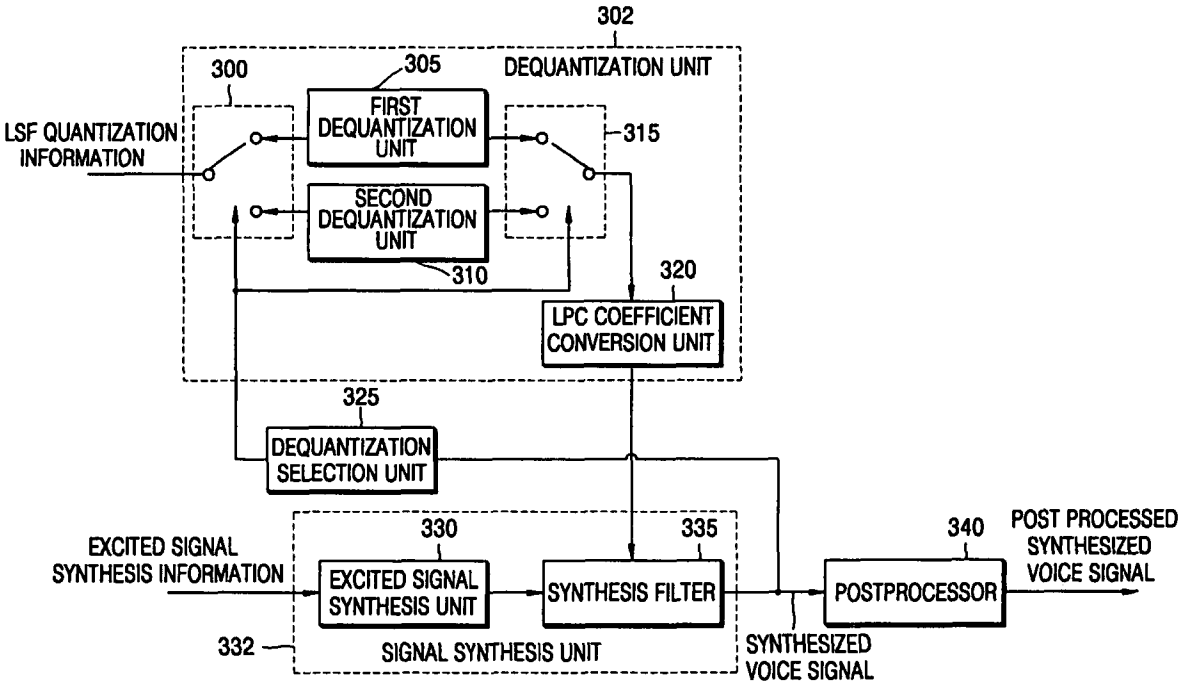
FIG. 3 is a block diagram showing a voice decoder in a CELP arrangement according to an embodiment of the present invention.

FIG. 3 is a block diagram showing a voice decoder in a CELP arrangement according to an embodiment of the present invention.

The voice decoder includes a dequantization unit 302, a dequantization selection unit 325, a signal synthesis unit 332 and a postprocessor 340. Here, the dequantization unit 302 includes a third selection switch 300, a first LSF dequantization unit 305, a second LSF dequantization unit 310, a fourth selection switch 315 and an LPC coefficient conversion unit 320. The signal synthesis unit 332 includes an excited signal synthesis unit 330 and a synthesis filter 335.

The third selection switch 300 outputs the LSF quantization information, transmitted through a channel to the first LSF dequantization unit 305 or the second LSF dequantization unit 310, according to the dequantization selection signal received from the dequantization selection unit 325. The quantized LSF restored by the first LSF dequantization unit 305 or the second LSF dequantization unit 310 is output to the fourth selection switch 315.

The fourth selection switch 315 outputs the quantized LSF restored by the first LSF dequantization unit 305 or the second LSF dequantization unit 310 to the LPC coefficient conversion unit 320 according to the dequantization selection signal received from the dequantization selection unit 325. The fourth selection switch 315 is synchronized with the third selection switch 300, and also with the first and second selection switches 215 and 230 of the voice encoder shown in FIG. 2. This is the reason why the voice signal synthesized by the voice encoder and the voice signal synthesized by the voice decoder are the same.

The LPC coefficient conversion unit 320 converts the quantized LSF into the quantized LPC coefficient, and outputs the quantized LPC coefficient to the synthesis filter 335.

The excited signal synthesis unit 330 receives the excited signal synthesis information received through the channel, synthesizes the excited signal based on the received excited signal synthesis information, and outputs the excited signal to the synthesis filter 335. The synthesis filter 335 filters the excited signal by using the quantized LPC coefficient received from the LPC coefficient conversion unit 320 to synthesize the voice signal. The synthesis of the voice signal is processed as shown in the following Equation 8.

$$\hat{s}(n) = \hat{x}(n) + \sum_{i=1}^{10} \hat{a}_i \cdot \hat{s}(n-i) \quad n = 0, \ldots, L-1 \qquad \text{[Equation 8]}$$

where, $\hat{x}(n)$ is the synthesized excited signal.

The synthesis filter 335 outputs the synthesized voice signal to the dequantization selection unit 325 and the postprocessor 340.

The dequantization selection unit 325 generates a dequantization selection signal representing the dequantization unit to be selected in the next frame, based on the synthesized voice signal, and the outputs the dequantization selection signal to the third and fourth selection switches 300 and 315.

The postprocessor 340 improves the voice quality of the synthesized voice signal. In general, the postprocessor 340 improves the synthesized voice by using the long section post processing filter and the short section post processing filter.

Figure 4:
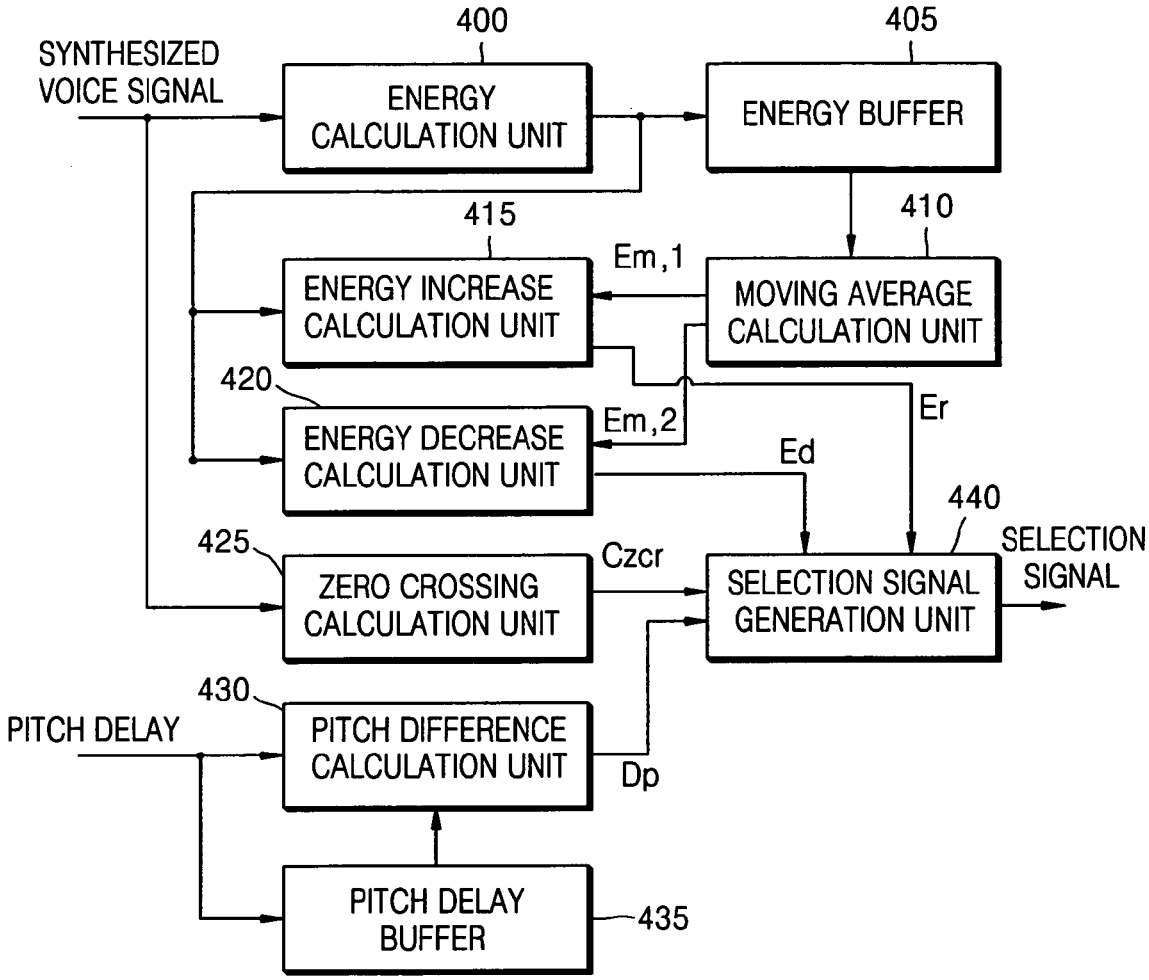
FIG. 4 is a block diagram showing an arrangement of a quantization selection unit and a dequantization selection unit of voice encoder/decoder according to the present invention.

FIG. 4 is a block diagram showing an arrangement of a quantization selection unit 240 and a dequantization selection unit 325 of voice encoder/decoder according to the present invention.

The quantization selection unit 240 of FIG. 2 and the dequantization selection unit 325 of FIG. 3 have the same arrangement. In other words, both of them include an energy calculation unit 400, an energy buffer 405, a moving average calculation unit 410, an energy increase calculation unit 415, an energy decrease calculation unit 420, a zero crossing calculation unit 425, a pitch difference calculation unit 430 and a pitch delay buffer 435, and a selection signal generation unit 440.

More specifically, the synthesized voice signal from the synthesis filter 275 of the voice encoder of FIG. 2 and the synthesized voice signal from the synthesis filter 335 of the voice decoder of FIG. 3 are input to the energy calculation unit 400 and the zero crossing calculation unit 425.

First, the energy calculation unit 400 calculates respective energy values Ei of the ith subframes. The respective energy values of the subframes are calculated as shown in the following Equation 9.

$$E_i = \sum_{n=0}^{L/N-1} \hat{s}\,(iL/N + n)^2 \quad i = 0, \ldots, N-1 \qquad \text{[Equation 9]}$$

where, N is the number of subframes, and L is the number of samples per frame.

The energy calculation unit 400 outputs the respective calculated energy values of the subframes to the energy buffer 405, the energy increase calculation unit 415 and the energy decrease calculation unit 420.

The energy buffer 405 stores the calculated energy values in a frame unit to obtain the moving average of the energy. The process in which the calculated energy values are stored into the energy buffer 405 is as shown the following Equation 10.

$$\text{for } i = L_B - 1 \text{ to } 1 \qquad \text{[Equation 10)}$$

$$E_B\ (i) = E_B(i-1)$$

$$E_B(O) = E_i$$

where, $L_B$ is a length of an energy buffer, and $E_B$ is an energy buffer.

The energy buffer 405 outputs the stored energy values to the moving average calculation unit 410. The moving average calculation unit 410 calculates two energy moving averages $E_M$,1 and $E_M$,2, as shown in Equations 11a and 11b.

$$E_{M,1} = \frac{1}{10}\sum_{i=5}^{9} E_B(i) \quad \text{[Equation 11a]}$$

$$E_{M,2} = \frac{1}{10}\sum_{i=0}^{9} E_B(i) \quad \text{[Equation 11b]}$$

The moving average calculation unit 410 outputs the two calculated energy values $E_M$,1 and $E_M$, 2 to the energy increase calculation unit 415 and the energy decrease calculation unit 420, respectively.

The energy increase calculation unit 415 calculates an energy increase $E_r$ as shown in Equation 12, and the energy decrease calculation unit 420 calculates an energy decrease $E_d$ as shown in Equation 13.

$$E_r = E_i / E_{M,1} \quad \text{[Equation 12]}$$

$$E_d = E_{m,2} / E_i \quad \text{[Equation 13]}$$

The energy increase calculation unit 415 and the energy decrease calculation unit 420 outputs the calculated energy increase $E_r$ and the energy decrease $E_d$ to the selection signal generation unit 440, respectively.

The zero crossing calculation unit 425 receives the synthesized voice signal from the synthesis filters 275, 335 of the voice encoder/decoder (FIGS. 2 and 3) and calculates a changing rate of a sign through the process of Equation 14. The calculation of zero crossing rate $C_{zcr}$ is performed over the last frame of the subframe.

$$C_{zcr}=0$$

$$\text{for } i=(N-1)L/N \text{ to } L-2$$

$$\text{if } \hat{s}(i)\cdot\hat{s}(i-1)<0$$

$$C_{zcr}=C_{zcr}+1$$

$$C_{zcr}=C_{zcr}/(L/N) \quad \text{[Equation 14]}$$

The zero crossing calculation unit 425 outputs the calculated the zero crossing rate to the selection signal generation unit 440.

The pitch delay is input to the pitch difference calculation unit 430 and the pitch delay buffer 435. The pitch delay buffer 435 stores the pitch delay of the last subframe prior to one frame.

In addition, the pitch difference calculation unit 430 calculates a difference $D_p$ between the pitch delay P(n) of the last subframe of the current frame and the pitch delay P(n−1) of the last subframe of the previous frame, using the pitch delay of prior subframe stored in the pitch delay buffer 435, as shown in the following Equation 15.

$$D_p=|P(n)-P(n-1)| \quad \text{[Equation 15]}$$

The pitch difference calculation unit 430 outputs the calculated difference of the pitch delay $D_p$ to the selection signal generation unit 440.

The selection signal generation unit 440 generates a selection signal selecting the quantization unit (dequantization unit for a voice decoder) appropriate to the voice encoding, based on the energy increase of the energy increase calculation unit 415, the energy decrease of the energy decrease calculation unit 420, the zero crossing rate of the zero crossing calculation unit 425, and the pitch difference of the pitch difference calculation unit 430.

Figure 5:
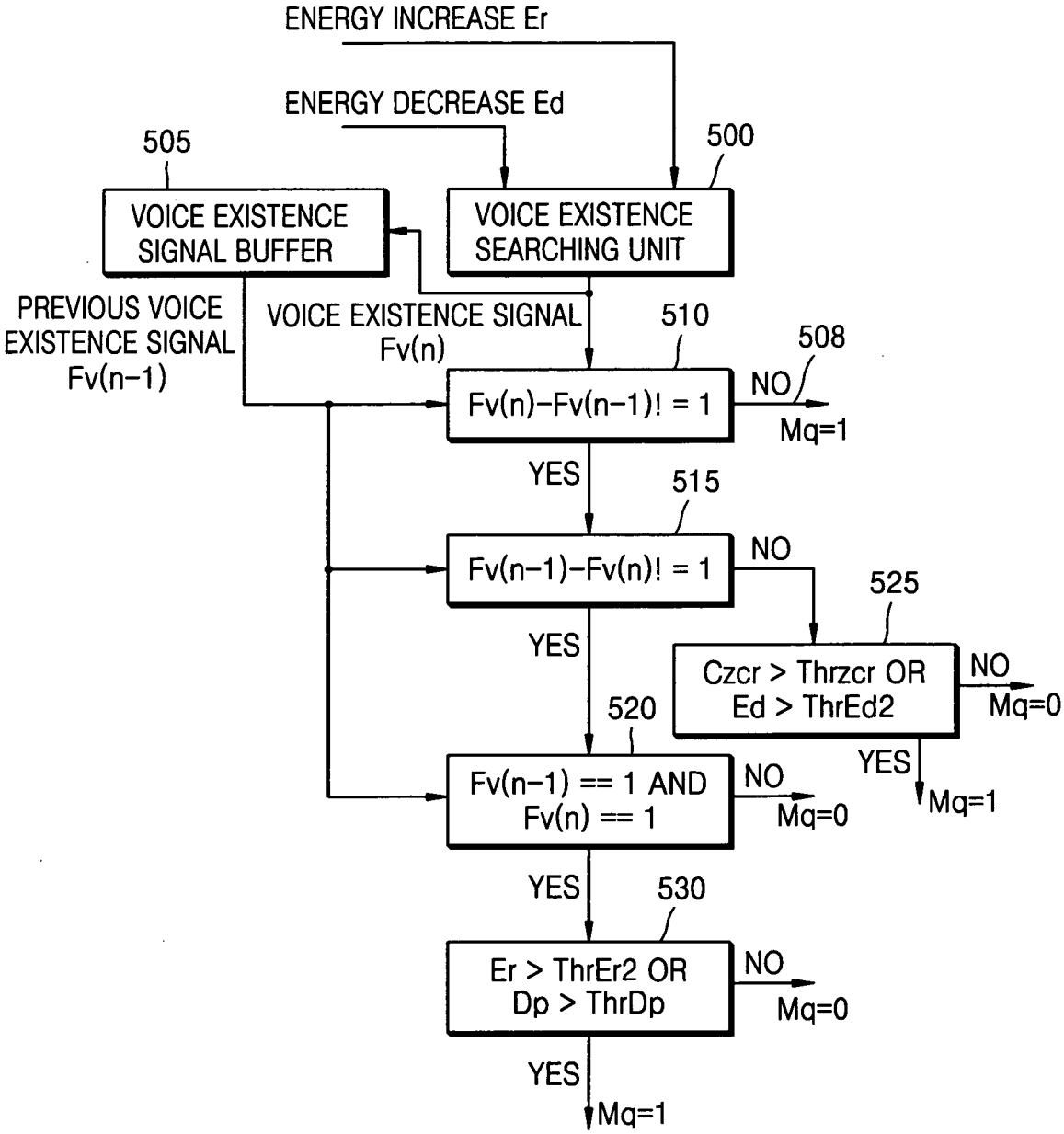
FIG. 5 is a flowchart for explaining operation of a selection signal generation unit of FIG. 4.

FIG. 5 is a flowchart for explaining operation of the selection signal generation unit 440 of FIG. 4.

Referring to FIGS. 4 and 5, the selection signal generation unit 440 includes a voice existence searching unit 500, a voice existence signal buffer 505 and a plurality of operation blocks 510 to 530.

The voice existence searching unit 500 receives the energy increase $E_r$ and the energy decrease $E_d$ from the energy increase calculation unit 415 and the energy decrease calculation unit 420 of FIG. 4, respectively. The voice existence searching unit 500 determines the existence of voice in the synthesized signal of the current frame, based on the received energy increase $E_r$ and the energy decrease $E_d$. This determination can be made by using the following Equation 16.

$$\text{if } E_r > Thr_{E_r} \text{ Then } F_v=1$$

$$\text{if } E_d > Thr_{E_d} \text{ Then } F_v=0 \quad \text{[Equation 16]}$$

where, $F_v$ is a signal representing a voice signal existence as '1' in case that the voice exists in the currently synthesized voice signal, and as '0' in case that the voice doesn't exist in the currently synthesized voice signal. The representation showing the voice existence can be made differently.

The voice existence searching unit 500 outputs the voice existence signal $F_v$ to the first operation block 510 and the voice existence signal buffer 505.

The voice existence signal buffer 505 stores the previously searched voice existence signal $F_v$ to perform logic determination of the plurality of operation blocks 510, 515 and 520, and outputs the previous voice existence signal to the respective first, second, and third operation blocks 510, 515, and 520.

The first operation block 510 outputs a signal to set a next frame LSF quantizer mode $M_q$ to 1 for a case that the voice exists in the synthesized signal of the current frame but doesn't exist in the synthesized signal of the previous frames. Otherwise, the second operation block is performed next.

The second operation block 515 causes the fourth operation block 525 to operate for a case that the voice doesn't exist in the synthesized signal of the current frame but exists in the synthesized signal of the previous frames. Otherwise, the second operation block 515 causes the third operation block 520 to operate.

The fourth operation block 525 outputs a signal to set the next frame LSF quantizer mode $M_q$ to 1 for a case that the zero crossing rate calculated by the zero crossing calculation unit 425 is $Thr_{zcr}$ or more, or the energy decrease $E_d$ is $Thr_{Ed2}$ or more. Otherwise, the fourth operation block 525 outputs a signal to set the next frame LSF quantizer mode $M_q$ to 0.

The third operation block 520 causes the fifth operation block 530 to operate for a case that all of the signals synthesized in the previous and current frames are voice signal. Otherwise, the third operation block 520 outputs a signal to set the next frame LSF quantizer mode $M_q$ to 0.

The fifth operation block 530 outputs a signal to set the next frame LSF quantizer mode $M_q$ to 1 for a case that the energy increase $E_r$ is $Thr_{Er2}$ or more, or the pitch difference $D_p$ is $Thr_{Dp}$ or more. Otherwise, the fifth operation block 530 outputs a signal to set the next frame LSF quantizer mode $M_q$ to 0.

Here, Thr refers to a specified threshold, and $M_q$ refers to a quantizer selection signal of FIG. 4. Therefore, when $M_q$ is 0, the first to fourth selection switches 215, 230, 300, and 315 select the first LSF quantization unit 220 (first LSF dequantization unit 305 in the case of the decoder) for the next frame. When $M_q$ is 1, the first to fourth selection signals 215, 230, 300, and 315 select the second LSF quantization unit 225 (second LSF dequantization unit 310 in the case of the decoder). In addition, the opposite case hereto may also be available.

According to the above-described embodiment of the present invention, an LSF can be efficiently quantized in a CELP type voice codec according to characteristics of the previous synthesized voice signal in a voice encoder/decoder. Thus, complexity can be reduced.

Although an embodiment of the present invention have been shown and described, the present invention is not limited to the described embodiment. Instead, it would be appreciated by those skilled in the art that changes may be made to the embodiment without departing from the principles and spirit of the invention, the scope of which is defined by the claims and their equivalents.

What is claimed is:

1. A voice encoder comprising:

a quantization selection unit generating a quantization selection signal to represent a result of a selecting, before quantizing a line spectral frequency (LSF) of a current frame of an input signal, one of a first LSF quantization unit and a second LSF quantization unit for the quantizing of the LSF of the current frame, wherein the selecting is based on analysis by the quantization selection unit of a generated synthesized voice signal of a previous frame of the input signal; and a quantization unit extracting a linear prediction coding (LPC) coefficient from the current frame of the input signal, converting the extracted LPC coefficient into the LSF of the current frame, quantizing the LSF of the current frame with the selected one of the first LSF quantization unit using a first predictor and the second LSF quantization unit using a second predictor, the second predictor being different from the first predictor, based on the quantization selection signal, and converting the quantized LSF into a quantized LPC coefficient.

2. The voice encoder according to claim 1, wherein the quantization unit includes:

an LPC coefficient extraction unit to extract a LPC coefficient of the previous frame from the input signal;

an LSF conversion unit to convert the extracted LPC coefficient of the previous frame into an LSF of the previous frame;

the first LSF quantization unit to quantize the LSF of the previous frame through a first quantization process;

the second LSF quantization unit to quantize the LSF of the previous frame through a second quantization process; and an LPC coefficient conversion unit to convert a quantized LSF of the previous frame, generated by a selected one of the first LSF quantization unit and the second LSF quantization unit to perform quantizing of the LSF of the previous frame, into a quantized LPC coefficient of the previous frame.

3. The voice encoder according to claim 2, wherein the LPC quantization unit extracts the LPC coefficient corresponding to the current frame using autocorrelation and a Levinson-Durbin algorithm.

4. The voice encoder according to claim 2, wherein the LSF conversion unit outputs the LSF of the previous frame to a selected one of the first quantization unit and the second LSF quantization unit according to a quantization selection signal generated for the selecting of the first LSF quantization unit and the second LSF quantization unit one of the quantizing of the LSF of the frame.

5. The voice encoder according to claim 1, wherein the quantization selection unit includes:

an energy variation calculation unit to calculate energy variations of the synthesized voice signal of at least the previous frame;

a zero crossing calculation unit to calculate a changing degree of a sign of the synthesized voice signal of at least the previous frame;

a pitch difference calculation unit to calculate a pitch delay of the synthesized voice signal of at least the previous frame; and a selection signal generation unit checking whether the synthesized voice signal of at least the previous frame has a voice signal based on the calculated energy variation, and generating the quantization selection signal based on a result of the checking indicating that the synthesized voice signal of at least the previous frame has the voice signal, the calculated changing degree of the sign of the synthesized voice signal of at least the previous frame, and the calculated pitch delay of the synthesized voice signal of at least the previous frame.

6. The voice encoder according to claim 5, wherein the energy variation calculation unit includes:

an energy calculation unit to calculate energy values in respective subframes constituting at least the previous frame;

an energy buffer to store the calculated energy values of the respective subframes;

a moving average calculation unit to calculate a moving average for the stored energy values of the respective subframes; and an energy increase/decrease calculation unit to calculate energy variation in at least the previous frame based on the calculated moving average and the calculated energy values of the respective subframes.

7. The voice encoder according to claim 1, further comprising:

a perceptual weighting filter perceptually weighting the input signal based on a quantized LPC coefficient of the previous frame;

a subtractor subtracting a specified synthesized signal from the perceptually weighted input signal to generate a linear prediction remaining signal; and a signal synthesis unit searching for an excited signal from the linear prediction remaining signal, generating the specified synthesized signal using the quantized LPC coefficient of the previous frame and an excited signal found in the searching, and outputting the specified generated synthesized signal to the subtractor.

8. A voice encoder comprising:

a quantization selection unit generating a quantization selection signal;

a quantization unit extracting a linear prediction coding (LPC) coefficient from a current frame of an input signal, converting the extracted LPC coefficient into a line spectral frequency (LSF), selectively quantizing the LSF with one of a first LSF quantization unit using a first predictor and a second LSF quantization unit using a second predictor, the second predictor being different from the first predictor, based on the quantization selection signal, and converting the quantized LSF into a quantized LPC coefficient of the current frame;

a perceptual weighting filter perceptually weighting the input signal based on a quantized LPC coefficient of a previous frame of the input signal;

a signal synthesis unit searching for an excited signal from a linear prediction remaining signal, generating a synthesized voice signal of the previous frame using the quantized LPC coefficient of the previous frame and an excited signal found in the searching, and outputting the generated synthesized voice signal to a subtractor;

the subtractor subtracting the synthesized voice signal from the perceptually weighted input signal to generate the linear prediction remaining signal; and, wherein the quantization selection signal determines the selecting of the one of the first LSF quantization unit and the second LSF quantization unit based on characteristics of the synthesized voice signal, and wherein the signal synthesis unit includes a synthesis filter synthesizing the synthesized voice signal using a synthesized excited signal of the input signal, from an excited signal synthesis unit based on the found excited signal, and the quantized LPC coefficient of the previous frame, received from the LPC coefficient conversion unit, and outputting the synthesized voice signal to the subtractor and the quantization selection unit.

9. The voice encoder according to claim 8, wherein the linear prediction remaining signal is generated using the following equation:

$$x(n) = s_w(n) - \sum_{i=1}^{10} \hat{a}_i \cdot \hat{s}(n-i) \quad n = 0, \ldots, L-1$$

wherein, x(n) is the linear prediction remaining signal, $s_w(n)$ is the perceptually weighted voice signal, $\hat{a}_i$ is an ith element of the quantized LPC coefficient vector, from the previous frame, $\hat{s}(n)$ is the synthesized voice signal, and L is the number of sample per one frame.

10. A voice decoder comprising:

a dequantization selection unit generating a dequantization selection signal, the dequantization selection signal representing a result of a selecting, before dequantizing line spectral frequency (LSF) quantization information of a current frame of an input signal, one of a first LSF dequantization unit and a second LSF dequantization unit for the dequantizing of the LSF quantization information, wherein the selecting is based on analysis by the dequantization selection unit of a generated synthesized voice signal of a previous frame of the input signal; and a dequantization unit dequantizing line spectral frequency (LSF) quantization information of the current frame to generate an LSF vector, and converting the LSF vector into a linear prediction coding (LPC) coefficient of the current frame, the LSF quantization information being received through a specified channel and dequantized using the selected one of the first LSF dequantization unit having a first predictor and the second LSF dequantization unit having a second predictor, the second predictor being different from the first predictor, wherein the synthesized voice signal is generated from synthesis information of a received voice signal.

11. The voice decoder according to claim 10, wherein the dequantization unit includes:

the first LSF dequantization unit to generate an LSF vector of the previous frame through a first dequantization process of LSF dequantization information of the previous frame;

the second LSF dequantization unit to generate the LSF vector of the previous frame through a second dequantization process of the LSF dequantization information of the previous frame; and an LPC coefficient conversion unit to convert the dequantized LSF vector of the previous frame, generated by a dequantizing of the LSF information using a selected one of the first LSF dequantization unit and the second LSF dequantization unit, into a dequantized LPC coefficient of the previous frame.

12. The voice decoder according to claim 10, wherein the dequantization selection unit includes:

an energy variation calculation unit to calculate energy variation of the synthesized voice signal of at least the previous frame;

a zero crossing calculation unit to calculate a changing degree of a sign of the synthesized voice signal of at least the previous frame;

a pitch difference calculation unit to calculate a pitch delay of the synthesized voice signal of at least the previous frame; and a selection signal generation unit checking whether the synthesized voice signal of at least the previous frame has a voice signal based on the calculated energy variation, and generating a dequantization selection signal based on a result of the checking indicating that the synthesized voice signal of at least the previous frame has the voice signal, the calculated changing degree of the sign of the synthesized voice signal of at least the previous frame, and the calculated pitch delay of the synthesized voice signal of at least the previous frame.

13. The voice decoder according to claim 12, wherein the energy variation calculation unit includes:

an energy calculation unit to calculate energy values in respective subframes constituting at least the previous frame;

an energy buffer to store the calculated energy values of the respective subframes;

a moving average calculation unit to calculate a moving average for the stored energy values of the respective subframes; and an energy increase/decrease calculation unit to calculate energy variation in at least the previous frame based on the calculated moving average and the calculated energy values of the respective subframes.

14. The voice decoder according to claim 11, further comprising a signal synthesis unit synthesizing an excited signal by using excited signal synthesis information of the input signal and the dequantized LPC coefficient of the previous frame received from the LPC coefficient conversion unit.

15. The voice decoder according to claim 14, further comprising an excited signal synthesis unit synthesizing the synthesize excited signal based on received excited signal synthesis information of the current frame, and outputting the synthesized excited signal to a synthesis filter filtering the synthesized excited signal.

16. The voice decoder according to claim 15, wherein the synthesized voice signal is synthesized according to the following equation:

$$\hat{s}(n) = \hat{x}(n) + \sum_{i=1}^{10} \hat{a}_i \cdot \hat{s}(n-i) \quad n = 0, \ldots, L-1$$

wherein $\hat{x}(n)$ is the synthesized excited signal.

17. A method of selecting quantization in a voice encoder, the method comprising:

extracting a linear prediction encoding (LPC) coefficient from a current frame of an input signal;

converting the extracted LPC coefficient into a line spectral frequency (LSF) of the current frame;

generating a synthesized voice signal of a previous frame of the input signal;

selecting, before quantizing the LSF of the current frame, one of a first LSF quantization process and a second LSF quantization process for the quantizing of the LSF of the current frame, wherein the selecting is based on an analysis of the generated synthesized voice signal;

quantizing the LSF through the selected one of the first quantization process using a first predictor and the second LSF quantization process using a second predictor, the second predictor being different from the first predictor; and converting the quantized LSF into an quantized LPC coefficient of the current frame.

18. A method of selecting quantization in a voice encoder, the method comprising:

extracting a linear prediction encoding (LPC) coefficient from an input signal;

converting the extracted LPC coefficient into a line spectral frequency (LSF);

selectively quantizing the LSF through one of a first quantization process using a first predictor and a second LSF quantization process using a second predictor, the second predictor being different from the first predictor, based on characteristics of a synthesized voice signal in previous frames of the input signal; and converting the quantized LSF into an quantized LPC coefficient, wherein the quantizing includes:

calculating an energy variation of the synthesized voice signal in the previous frames of the input signal;

calculating a changing degree of a sign of the synthesized voice signal in the previous frames of the input signal;

calculating a pitch delay of the synthesized voice signal in the previous frames of the input signal; and checking whether the synthesized voice signal in the previous frames of the input signal has a voice signal based on the energy variation to perform the first quantization process or the second LSF quantization process, wherein the first quantization process or the second LSF quantization process is performed based on whether the synthesized voice signal has the voice signal, a changing degree of the sign of the synthesized voice signal, and a pitch delay of the synthesized voice signal.

19. A method of selecting dequantization in a voice decoder, comprising:

receiving line spectral frequency (LSF) quantization information of a current frame of an input signal and voice signal synthesis information of the current frame through a specified channel;

generating a synthesized voice signal of a previous frame of the input signal from the voice signal synthesis information of the current frame and LSF quantization information of the previous frame;

selecting, before dequantizing an LSF of the of the current frame, one of a first LSF dequantization process and a second LSF dequantization process for the dequantizing of the LSF of the current frame, wherein the selecting is based on an analysis of the synthesized voice signal;

dequantizing the LSF of the current frame through the selected one of the first dequantization process using a first predictor and the second LSF dequantization process using a second predictor, the second predictor being different from the first predictor, to generate a dequantized LSF vector of the current frame; and converting the dequantized LSF vector into a dequantized LPC coefficient of the current frame.

20. The method according to claim 19, wherein the dequantizing includes:

calculating an energy variation of the synthesized voice signal of at least the previous frame;

calculating a changing degree of a sign of the synthesized voice signal of at least the previous frame;

calculating a pitch delay of the synthesized voice signal of at least the previous frame; and checking whether the synthesized voice signal in at least the previous frame has a voice signal based on the calculated energy variation, wherein the one of the first dequatization process and the second dequantization process is selected based on a result of the checking indicating that the synthesized voice signal of at least the previous frame has the voice signal, the calculated changing degree of the sign of the synthesized voice signal of at least the previous frame, and the calculated pitch delay of the synthesized voice signal of at least the previous frame.

21. An apparatus for selecting quantization for a current frame of an input signal in a voice encoder, the apparatus comprising:

an energy calculation unit to calculate respective energy values of subframes of at least a previous frame based upon a synthesized voice signal of at least the previous frame;

an energy buffer to store the calculated energy values;

a moving average calculation unit to calculate two energy moving values based on the stored calculated energy values;

an energy increase calculation unit to calculate an energy increase based on the calculated energy values and the calculated two energy moving values;

an energy decrease calculation unit to calculate an energy decrease based on the calculated energy values and the calculated two energy moving values;

an zero crossing calculation unit to calculate a changing zero crossing rate of the synthesized voice signal;

a pitch difference calculation unit to calculate a difference in a detected pitch delay of the synthesized voice signal; and a selection signal generation unit to select, before performing quantization of the current frame using any of plural quantization units, which one of the plural quantization units is appropriate for the voice encoding of the current frame based on the synthesized voice signal of at least the previous frame, including consideration of the calculated energy increase, the calculated energy decrease, the calculated zero crossing rate, and the calculated pitch difference.

22. The quantization selection unit according to claim 21, wherein the energy calculation unit calculates respective energy values Ei of ith subframes according to the following equation:

$$E_i = \sum_{n=0}^{L/N-1} \hat{s}\,(iL/N+n)^2 \quad i = 0, \ldots, N-1$$

wherein N is a number of subframes, and L is a number of samples per frame.

23. The quantization selection unit according to claim 21, wherein the energy buffer stores the calculated energy values in a frame unit according to the following equation:

for $i=L_B-1$ to 1

$E_B(i)=E_B(i-1)$ $E_B(O)=E_i$ wherein $L_B$ is a length of an energy buffer, and $E_B$ is an energy buffer.

24. The quantization selection circuit according to claim 22, wherein the moving average calculation unit calculates two energy moving averages $E_M$,1 and $E_M$,2 according to the following equations:

$$E_{M,1} = \frac{1}{10}\sum_{i=5}^{9} E_B(i)\text{; and } E_{M,2} = \frac{1}{10}\sum_{i=0}^{9} E_B(i).$$

25. An apparatus for selecting dequantization for a current frame of an input signal in a voice decoder, the apparatus comprising:

an energy calculation unit to calculate respective energy values of subframes of a previous frame of the input signal based on a synthesized voice signal of at least the previous frame;

an energy buffer to store the calculated energy values;

a moving average calculation unit to calculate two energy moving values based on the stored calculated energy values;

an energy increase calculation unit to calculate an energy increase based on the calculated energy values and the calculated two energy moving values;

an energy decrease calculation unit to calculate an energy decrease based on the calculated energy values and the calculated two energy moving values;

an zero crossing calculation unit to calculate a changing zero crossing rate of the synthesized voice signal;

a pitch difference calculation unit to calculate a difference in a detected pitch delay of the synthesized voice signal; and a selection signal generation unit to generate, before performing dequantization of the current frame using any of plural dequantization units, a selection signal representing a selection of which one of the plural dequantization units is appropriate for the voice encoding of the current frame based on the synthesized voice signal of at least the previous frame, including consideration of the calculated energy increase, the calculated energy decrease, the calculated changing zero crossing rate, and the calculated pitch difference.

26. The dequantization selection unit according to claim 25, wherein the energy calculation unit calculates respective energy values Ei of ith subframes according to the following equation:

$$E_i = \sum_{n=0}^{L/N-1} \hat{s}(iL/N+n)^2 \quad i = 0, \ldots, N-1$$

wherein N is a number of subframes, and L is a number of samples per frame.

27. The dequantization selection unit according to claim 25, wherein the energy buffer stores the calculated energy values in a frame unit according to the following equation:

for $i=L_B-1$ to 1

$E_B(i)=E_B(i-1)$ $E_B(O)=E_i$ wherein $L_B$ is a length of an energy buffer, and $E_B$ is an energy buffer.

28. The dequantization selection circuit according to claim 25, wherein the moving average calculation unit calculates two energy moving averages $E_M$,1 and $E_M$,2 according to the following equations:

$$E_{M,1} = \frac{1}{10}\sum_{i=5}^{9} E_B(i)\text{; and } E_{M,2} = \frac{1}{10}\sum_{i=0}^{9} E_B(i).$$

29. A voice encoder comprising:

a quantization selection unit checking whether a synthesized voice signal of previous frames of an input signal has a voice signal based on energy variations of the synthesized voice signal of the previous frames of the input signal, and selecting, before quantizing a line spectral frequency (LSF) of a current frame of the input signal, one of a first LSF quantization unit and a second LSF quantization unit for the quantizing of the LSF of the current frame based on a result of the checking indicating that the synthesized voice signal of the previous frames has the voice signal, a changing degree of a sign of the synthesized voice signal, and a pitch delay of the synthesized voice signal of the previous frames; and a quantization unit quantizing the LSF of the current frame with the selected one of a first LSF quantization unit using a first predictor and the second LSF quantization unit using a second predictor, the second predictor being different from the first predictor, and converting the quantized LSF into a quantized LPC coefficient.

30. A voice encoder comprising:

a quantization selection unit generating a quantization selection signal; and a quantization unit extracting a linear prediction coding (LPC) coefficient from an input signal, converting the extracted LPC coefficient into a line spectral frequency (LSF), selectively quantizing the LSF with one of a first LSF quantization unit using a first predictor and a second LSF quantization unit using a second predictor, the second predictor being different from the first predictor, based on the quantization selection signal, and converting the quantized LSF into a quantized LPC coefficient, wherein the quantization selection signal determines the selecting of the one of the first LSF quantization unit and the second LSF quantization unit based on characteristics of a synthesized voice signal in previous frames of the input signal, wherein the LSF is input only to the selected one quantization unit in which the LSF is selectively quantized.

* * * * *

UNITED STATES PATENT AND TRADEMARK OFFICE

CERTIFICATE OF CORRECTION

PATENT NO. : 8,473,284 B2
APPLICATION NO. : 11/097319
DATED : June 25, 2013
INVENTOR(S) : Kangeun Lee et al.

It is certified that error appears in the above-identified patent and that said Letters Patent is hereby corrected as shown below:

In the Claims:

Line 36, Column 13, In Claim 9, delete "of the" and insert -- of a --, therefor.

Line 36, Column 13, In Claim 9, delete "vector," and insert -- vector --, therefor.

Line 61, Column 15, In Claim 19, delete "of the of the" and insert -- of the --, therefor.

Line 18, Column 16, In Claim 20, delete "dequatization" and insert -- dequantization --, therefor.

Line 14, Column 17, In Claim 24, delete "circuit" and insert -- unit --, therefor.

Line 14, Column 18, In Claim 28, delete "circuit" and insert -- unit --, therefor.

Signed and Sealed this
Fifteenth Day of October, 2013

Teresa Stanek Rea

Teresa Stanek Rea
*Deputy Director of the United States Patent and Trademark Office*